United States Patent [19]

O'Hare

[11] 4,431,385

[45] Feb. 14, 1984

[54] SOLAR DISPLACEMENT PUMP

[76] Inventor: Louis R. O'Hare, 1700 Banyan #3, Fort Collins, Colo. 80526

[21] Appl. No.: 322,027

[22] Filed: Nov. 16, 1981

[51] Int. Cl.[3] ..... F04B 49/00; F04B 19/24

[52] U.S. Cl. ..... 417/379; 417/209

[58] Field of Search ..... 417/118, 120, 137, 144, 417/207, 208, 209, 379; 60/641.8, 641.11

[56] References Cited

U.S. PATENT DOCUMENTS 4,171,617 10/1979 Sakamoto et al. ..... 60/641.8

FOREIGN PATENT DOCUMENTS 2733995 2/1979 Fed. Rep. of Germany ..... 417/379

2756585 6/1979 Fed. Rep. of Germany ..... 60/641.8

*Primary Examiner*—Leonard E. Smith

[57] ABSTRACT

A boilerless steam displacement pump for pumping water is disclosed which uses steam not only to displace water from a chamber to pump the water but also uses the pressurized steam to charge and energize an internal water-to-steam delivery system in order to present water to the steam generating chamber without the use of any auxiliary pump. In this way steam being generated intermittently is used in one period of a cycle to supply water under pressure to the water-to-steam delivery system and then this system delivers the pressurized water to the steam generating chamber during an alternate period to produce the succeeding surge of steam.

12 Claims, 10 Drawing Figures

SOLAR DISPLACEMENT PUMP

This invention is a continuation-in-part of my previous application called, "Pulsing Steam Solar Water Pump" Ser. No. 101,218 filed Dec. 7, 1979, U.S. Pat. No. 4,309,148.

This invention is a type of water pump in which pressurized steam is made to displace water from a chamber and to drive the water through a pipe for useful purposes. In a principal embodiment solar radiation is used to convert water to steam according to conventional solar art using concentrating solar collectors or black box collectors. In other embodiments other sources of heat are employed such as combustion heating of hydrocarbon fuels or the burning of combustible fuels such as wood, coal etc. This displacement pump is like two other such pumps which have copending applications. It is like the one of my copending application called, "Pulsing Steam Solar Water Pump" of Ser. No. 101,218 filed Dec. 7, 1979, now U.S. Pat. No. 4,309,148 and it also resembles the pump of my copending application called "Solar Water Pump" of Ser. No. 246,708 filed Mar. 23, 1983 now U.S. Pat. No. 4,409,961. These pumps are all similar in that they do not use a boiler in the conventional sense but rather use a flash type generation of steam by impinging small discrete quantities of water against a very hot surface in order to produce short surges of steam. They differ from conventional art in that a large quantity of water and steam are not heated together with the steam being intermittently valved from the boiler to another area where it is used to displace water. As in the case of the copending applications the object of this invention is to preclude the requirement of having to heat a large volume of water at one time for those instances in which relatively small quantities and periods of energy are available in a given time. For instance, as in the case of solar radiation which is often intermittent during periods of partial overcast, it could require a very long wait to heat an entire boiler to steam temperature yet short surges of steam could be generated to do some work for the brief period while the sun is shining if only a small quantity of water were heated at a time. This system also eliminates the expense of the boiler and of the insulation required to prevent heat loss while a large volume of water is slowly being heated. However, this present invention differs from each of the copending applications. It removes the requirement for an auxiliary pump operated by solar cells and it provides a more effective means of delivering water to the pumps internal steam generating chamber. In this present invention there is no requirement to have the water level in the displacement chamber to be at a higher elevation than the elevation of the water inlet to the solar collector. Now this elevation is required for only a small quantity of water and some energy is conserved and used for more effective pumping. In one basic embodiment of the basic inventive concept the positive pressure of the steam being used to pump water is also used to provide the pressure to deliver the water to the steam generating chamber. The water to be used for conversion to steam is placed under pressure or elevated by the steam during a high pressure period of a cycle and then maintained under pressure until a low pressure period of the pumping cycle occurs. At that time this pressurization on the water will force it into the steam generating chamber.

Besides the object of providing a less costly and more effective delivery system to the steam generator another object is to provide a pump less dependent on higher technology. Accordingly, one embodiment removes not only the requirement for electric motor technology but also removes the need for any electric technology. By this object the boilerless displacement pump is simplified and made more useful for developing countries. The manner in which these objects are realized will be clarified by referring to the drawings.

FIG. 1 of the drawings shows a solar collector and the tanks of a steam displacement pump with a valve bank set to admit water to the steam generating chamber.

FIG. 2 of the drawings shows the same steam generating collector with the same tanks and valves and having the valves set to admit water to the upper tank.

Figure 4:
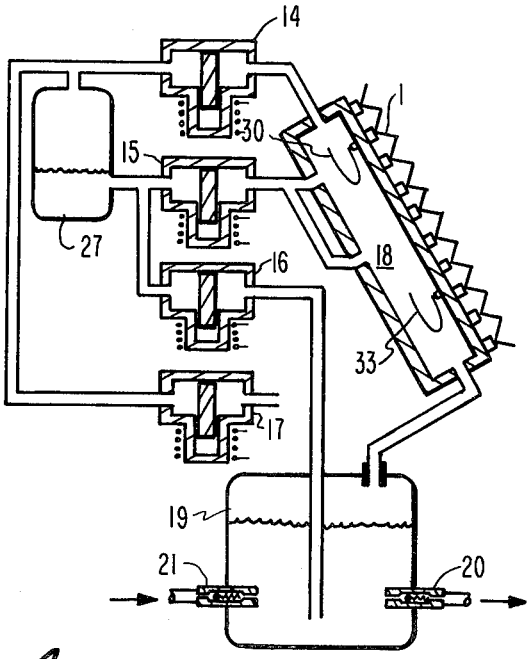
FIG. 4 shows the elements of the solar displacement pump with four electrically operated valves.
Figure 7:
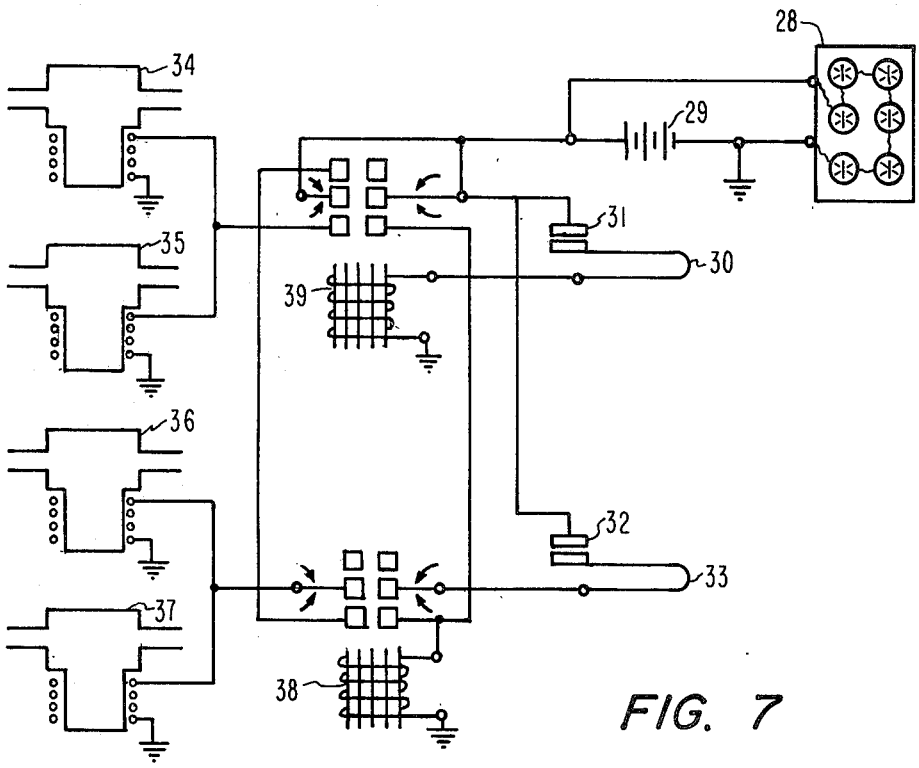

FIG. 7 of the drawings shows a schematic diagram of the electric relays and thermostats capable of controlling the electric valves of FIG. 4.

Figure 8:
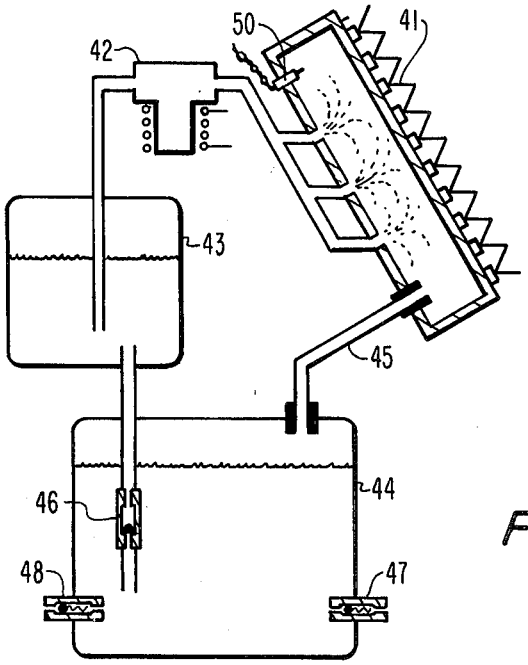

FIG. 8 shows a displacement pump using a solar collector with a steam displacement tank and a small water delivery tank operating only by one electric valve.

Figure 9:
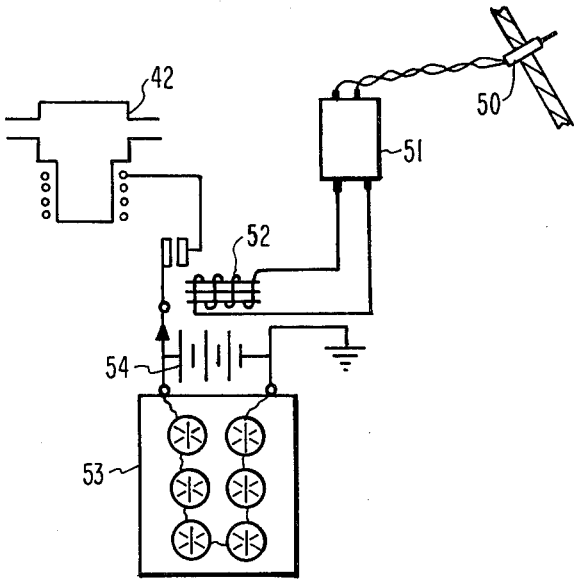

FIG. 9 shows an electric schematic of a circuit capable of operating the electric valve of FIG. 8.

Figure 10:
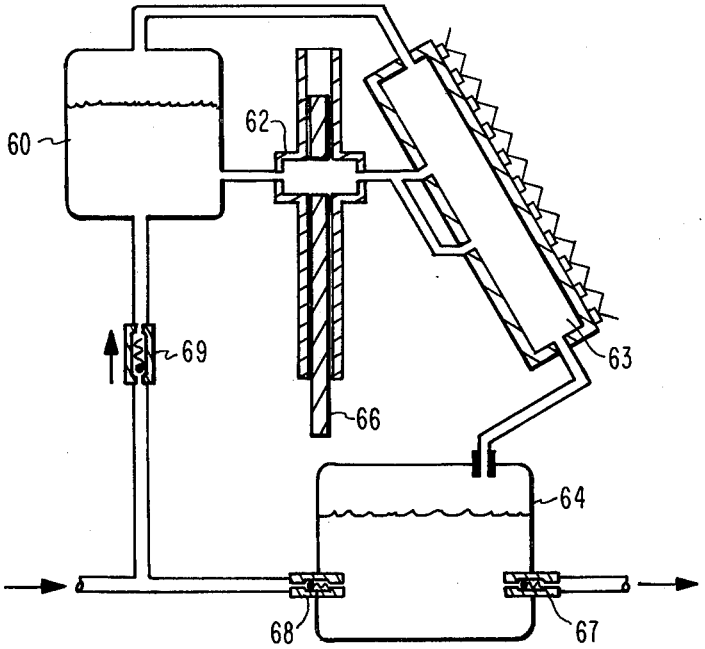

FIG. 10 shows a solar water pump using steam displacement in which the upper water delivery tank has a check valve in its water inlet line.

Figure 1:
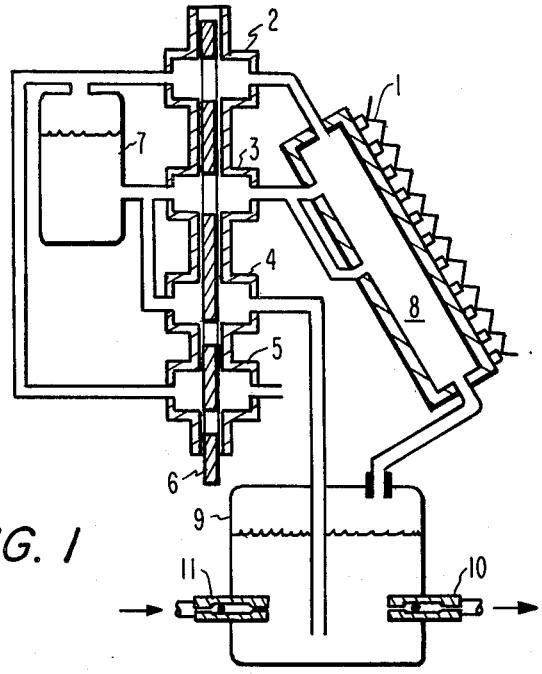

Referring then to FIG. 1 of the drawings, when the concentrating solar collector 1 is heated to a temperature at which high pressure steam can be generated then the valves 2 and 3 are opened by a downward movement of control bar 6 to its lowest position. This same position of 6 keeps valves 4 and 5 closed during this period. Valve 3 admits water from water delivery chamber 7 into the steam generating chamber 8 of collector 1. Valve 2 in its open condition allows the pressure over the water in chamber 7 to equalize with the pressure in 8 enabling a gravity feed of water from 7 to 8. The water is converted to steam in 8 when it contacts the heated surface of 8. The steam pressure is applied over the water column in the displacement chamber 9 to impel the water through the exit check valve 10 until the temperature and the pressure of the steam have been reduced. Inlet check valve 11 is closed at this time.

Figure 2:
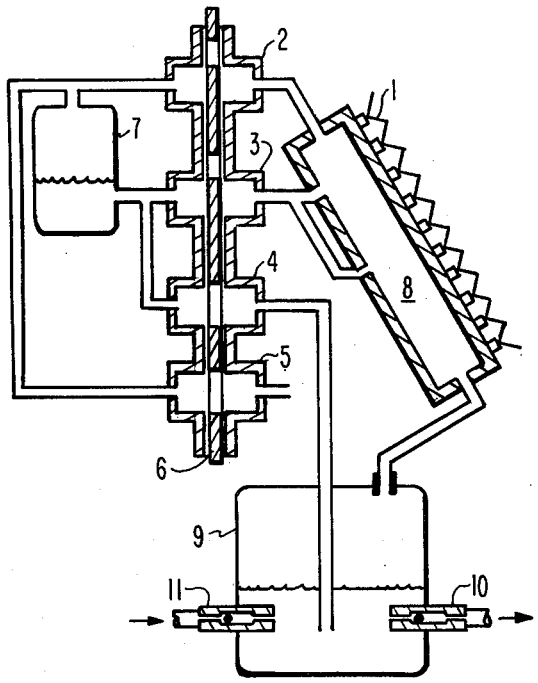

Referring then to FIG. 2, the elements are the same as those of FIG. 1. but in this FIG. 2 the condition of the valves is different. When the temperature and the pressure of the steam is somewhat reduced, valves 2 and 3 are closed and valves 4 and 5 are opened by an upward movement of control bar 6 to an intermediate position between its lowest and uppermost positions. The open condition of valve 5 relieves pressure over the water in 7 and the open condition of 4 admits water that is under pressure from the steam in 9. This pressure on the water in 9 forces water into 7 at this time. The quantity of water moved is determined by the duration of the time that 4 and 5 are opened and 2 and 3 are closed as well as by the diameter of the ducting 12 which leads from 9 to 7. As the temperature in 8 continues to lower the condition of the valves 4 and 5 is made to change. The change is shown in FIG. 3.

Figure 3:
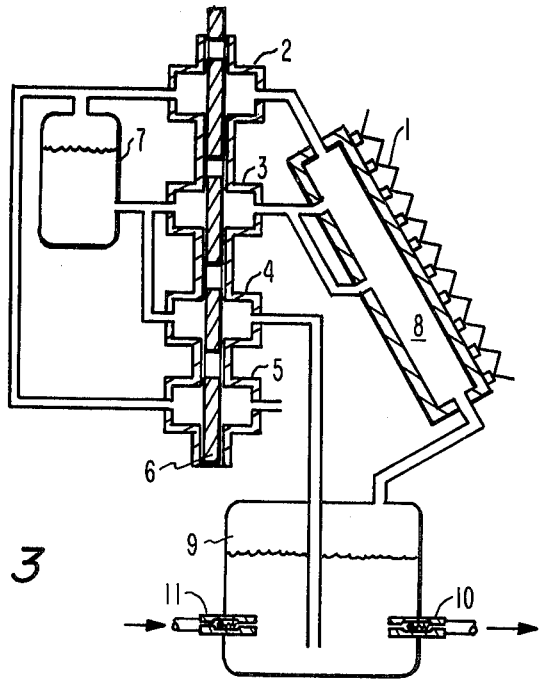
FIG. 3 shows the same basic elements as FIGS. 1 and 2 but with the upper four valves all being closed for an intake cycle.

To refer then to FIG. 3, the changed condition of the valves 4 and 5 is shown. The position of control bar 6 is also changed in order to effect that valve change. In its new position 6 maintains the closed condition of 2 and 3 while closing 4 and 5. All of the other elements of FIG. 2 remain the same in this FIG. 3. During the period illustrated by FIG. 3, steam condensing in 9 reduces the pressure in 9 and since additional steam is not being generated in 8 due to the closing of 3 then the vacuum formed in 9 draws in water through inlet check valve 11 during this part of the cycle. There is no water being received into 8 at this time and with no water to cool 8 it again becomes heated by solar radiation (or by other sources of thermal energy in other embodiments). When steam generating chamber 8 reaches a temperature at which pressurized steam may be produced then control bar 6 is abruptly moved from its uppermost position to its lowest position and water is again admitted to 8 to repeat the first part of the cycle described in FIG. 1.

In the FIG. 4, the electric valves 14 and 15 serve the same purpose as mechanical valves 2 and 3 respectively of FIG. 1, so 14 and 15 are opened and closed in the same sequence as are valves 2 and 3 according to the steps of the sequence as described beginning in FIG. 1 then in FIG. 2 and then in FIG. 3. Similarly, electric valves 16 and 17 serve the same purposes as valves 4 and 5 respectively of FIGS. 1 through 3. In this FIG. 4 the other elements are the same as those of FIG. 1. That is to say 18 is the same as 8 of FIG. 1 and 19 is the same as 9 of FIG. 1. In this FIG. 4 the check valves 20 and 21 are the same as 10 and 11 respectively of FIG. 1. In this FIG. 4, chamber 27 is the same as 7 of FIG. 1. According to the procedure described in the sequence of the first three figures the valves 14 and 15 are opened or closed for a given step whenever valves 2 and 3 are described as opened or closed in those figures. Similarly, valves 16 and 17 are opened or closed in a given step according to the described opening or closing of valve 4 and 5 for that part of the sequence. In place of the control bar 6 actuating the valves of this FIG. 4, an electric current is used to determine the condition of the valves and the presence or absence of this current to respectively either open or close a given set of valves in a given period of a cycle is determined by temperature sensing thermostats inside the steam generating chamber 18. Thermostats 30 and 33 are described in FIG. 7.

Figure 5:
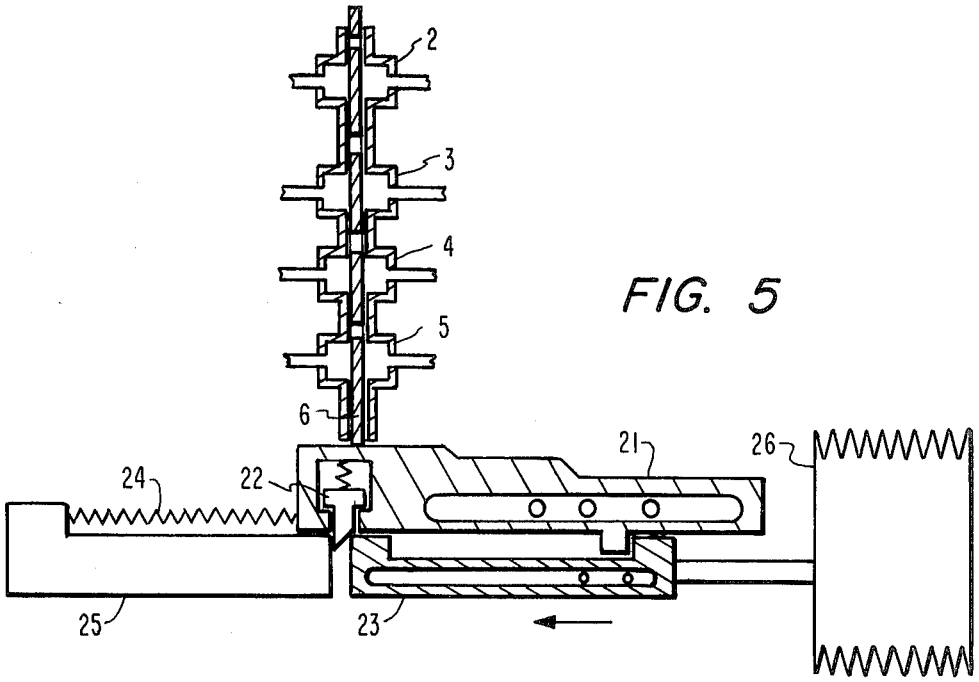
FIG. 5 shows a valve operating escapement mechanism driven by a bellows and in a position to close all of the valves.

Next in the FIG. 5, the sliding cam 21 positions valve control bar 6. This control bar 6 is the same as control bar of FIGS. 1 through 3. Further, just as in FIGS. 1 through 3, bar 6 must be in its full upward position closing all the valves while the steam generating chamber heats, accordingly in this FIG. 5 the means are shown for that holding of 6 in that position. The highest land of the sliding cam 21 holds control bar 6 in its uppermost position. Latching pin 22 holds 21 to the limits of its rightmost travel in order that cam 21 may keep 6 in its full upward position and hold the valves all closed while the generating chamber heats sufficiently to expand bellows 22. When 22 has expanded to a point dictated by a temperature that is high enough for the generation of pressurized steam, then escapement trigger 23 depresses pin 22 to release cam 21. Then spring 24 moves cam 21 to the leftmost limit of its travel. From that position the bellows 22 pulls 21 along to the right. The bellows 22 is moving to the right at this time because it is contracting as it cools, and it is cooling because the steam generating chamber is cooling as its heat is given up in the production of steam. As 21 is drawn rightward by contacting 22, first the lowest land of 21 supports 6, then the middle land supports 6, then the upper land. The lowest land of cam 21 produces the valving condition of FIG. 1. The middle land produces the condition of FIG. 2 and the upper land produces the condition shown in FIG. 3. From this last condition the escapement quickly returns to the first condition by the action of spring 24. In this embodiment the bellows is prevented from reacting to pressure changes by being shielded in a box that is vented to ambient outside pressure. The box with the bellows is heated and cooled by its position within the steam generating chamber. The bellows arm slides through an opening in the box. The opening has a seal to prevent leakage between the arm and the box. The box with its seal is not shown for the sake of clarity of the other elements positions in the diagram and because the practice of using a bellows to respond to heat alone is well understood in the art. Stationary member 25 supports spring 24.

Figure 6:
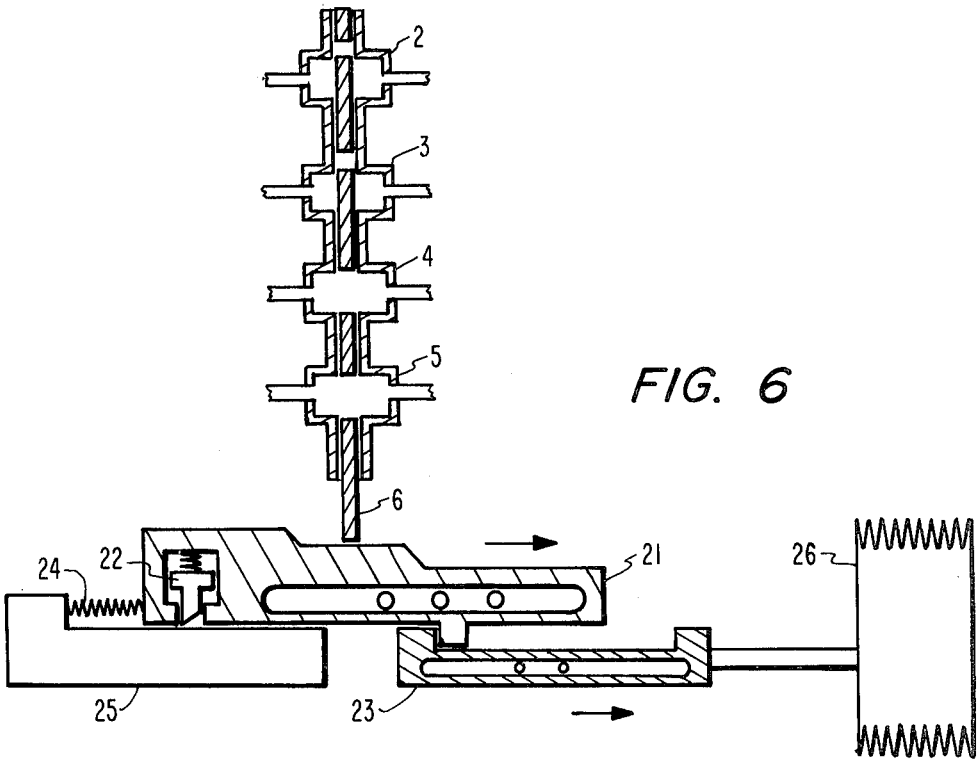
FIG. 6 shows the same valve operating escapement as in the following figure but with the escapement closing the upper two valves and opening the lower two valves.

Next in FIG. 6 which has all of the same elements as FIG. 5 but which shows these elements in different positions, the slider cam 21 is shown in its intermediate position. In this position valve control bar 6 opens only valves 4 and 5 and closes valves 2 and 3.

In FIG. 7, the electric circuitry for operating the electric valves 14, 15, 16 and 17 of FIG. 4 is shown. In this FIG. 7 the valves 34, 35, 36 and 37 are the same as the valves 14 through 17 of FIG. 4. As explained in reference to FIG. 4, it is necessary to open the valves 14 and 15 together when steam generating temperature is reached, but at other periods in the pumping cycle these valves are closed, as when they are closed for the period of condensation in order that the vacuum formed then might draw in water to the displacement chamber. Accordingly, the high temperature thermostat 30, shown located inside of chamber 18 in FIG. 4, will close its contacts 31 when a high steam generating temperature is reached. The current will be conducted to 34 and 35 to open these valves in order to deliver water to chamber 18. The current to valves 34 and 35 is conducted through contacts 32 of the low temperature thermostat 33. This thermostat 33 is also shown in its position at the base of steam generating chamber 18 in FIG. 4. The contacts of 32 are set to become closed at a lower temperature than are the contacts of 31, but contacts 32 close at a temperature at which a lower pressure steam may be generated. Since contacts 32 control the pressure at which water is impelled into water-delivery tank 27, a lower heat is sufficient because only a residual pressure is required to move a small quantity of water at this part of the cycle into tank 27. Contacts 32 will open 36 and 37 only after contacts 31 open and providing contacts 31 previously closed. It is not intended that 36 and 37 be opened as the temperature gradually increases because then excessive heat would be lost in merely filling the delivery tank 17 of FIG. 4. Therefore as the temperature gradually rises contacts 32 do close at a low steam generating temperature but the circuit to 36 and 37 is still kept open. When finally the temperature has risen enough for producing high pressure steam and 31 close to open 34 and 35, then finally are contacts 32 enabled to open 36 and 37 but they do not yet actually open 36 and 37. This happens only when contacts 31 open during a cooling cycle and provided 31 closed at the peak of a heating cycle.

In terms of the electric circuitry, when both thermometers have their contacts closed then relay 38 latches because the coil of 38 is energized and its right hand armature engages the lower right contact to continue a current flow to 38. The left hand armature of 39 completes the circuit to 34 and 35 when 39 is energized. Since the right hand armature of 38 then moves downward to engage the lower right contact of 38 a circuit is completed which continues to admit current to 38 holding both of its armatures down latching relay 38. However, latching 38 does not complete a circuit to 36 and 37 and these valves stay closed during a heating cycle, even though 32 is conducting during part of the heating cycle. Valves 36 and 37 stay closed and without current even at the top of the heating cycle because both 38 and 39 are energized then. It is only after the left hand armature of 39 is released by the opening of 31 during cooling that that left hand armature can engage the upper left contact of 39 and cause 36 and 37 to open. Then, as cooling progresses further and the temperature drops below steam generating degrees, the low temperature thermometer 33 opens its contacts 32 and current flow stops and all valves close. The valves then remain closed until cooling is completed and the subsequent heating reaches its peak. Solar cell 28 and battery 29 power the valves and relays.

Referring to FIG. 8, when the steam generating chamber 40 is heated by solar collector elements 41 and reaches a high steam generating temperature, then electric valve 42 opens and air pressure over the water in delivery tank 43 forces water from 43 into 40 where it is converted to steam. The water continues to flow from 43 into 40 until the steam pressure transmitted by duct 45 into the displacement tank 44 is greater than the air pressure over the water in 43. The water is forced through check valve 46 into 43 while other water from 44 is impelled out through check valve 47. When the temperature lowers in 40, valve 42 closes and steam condensation in 44 produces a vacuum there which draws in water through inlet check valve 48. Chamber 40 continues heating and its temperature rises to a point at which it will again be sufficiently hot to convert another increment of water to steam and the cycle is again repeated. Probe 50 senses temperature.

In FIG. 9 the electric circuitry which operates the electric valve 42 of FIG. 8 is shown in schematic form. The electric temperature probe 50 may be a thermocouple or a temperature variable resistor. Probe 50 provides a temperature dependent voltage which is amplified by amplifier 51. This amplifier 51 is variable with respect to gain and is adjusted to provide an output current which will energize relay 52 when the temperature of the steam generating chamber is sufficient to produce high pressure steam. Electric power to operate 51 and 42 as well as valve 42 is provided by solar cells 53 and by battery 54. This current energizes 42 to open it when voltage from 50 amplified by 40 corresponds to an adequate temperature in the steam generating chamber 40.

To refer to FIG. 10, the refilling of the water delivery tank 60 is accomplished by a vacuum transmitted to the tank during the intake cycle. The tank 60 delivers water to the steam generating chamber 63 during a subsequent period when valve 62 is opened in response to an elevation of the temperature in the steam chamber of collector 63. The tank 60 is elevated above the level of the solar collector chamber 63 and initially filled with water. At steam generating temperature in 63 valve 62 is opened admitting water to 63 where it is converted to steam and the pressure of the steam, transmitted to displacement tank 64 by duct 65, impels the water in 64 through exit check valve 67. When the generation of the steam in 63 has lowered its temperature then 62 is closed. Condensing steam produces a vacuum which draws in water through inlet check valve 68. This same vacuum is produced over the water remaining in 60 but since 62 is closed this vacuum draws in water through check valve 69. The escapement of FIG. 5 operates the control bar 66 which is like control bar 6 of FIG. 5. Because the cam 21 of FIG. 5 has 3 lands and control bar 6 of FIG. 5 has three possible positions, the control bar 66 also has three positions but only the lowest position on the bottom land of 21 of FIG. 4 will cause the valve control bar 66 of this FIG. 10 to open the valve 62 to admit water for steam generation. In another embodiment an electric valve with the electric circuit of FIG. 9 is used in place of 62 and the escapement of FIG. 5. The electric valve and circuit that does this are those of FIG. 9. Valve 42 in this embodiment replaces valve 62 so that the output of tank 60 into 63 is controlled by the electric circuitry of FIG. 9. In this FIG. 10 the duct 61 always assures that the pressure or the vacuum on the water in 60 will be the same as that in displacement tank 64. When there is a vacuum in 64 during the steam condensation period inlet check valve 68 admits water to 64 while 69 admits water to 60.

Throughout the drawings the steam generating chamber is shown in the form of a solar collector which heats a sealed chamber, but these illustrations are not meant to limit the inventive concept to one form of heating and any strong sealed chamber may be used and heated by a variety of means. For instance, in place of chamber 8 in FIG. 1 a differently shaped chamber such as one with a cylindrical shape may be used and it may be heated by methane gas jets connected to a biogas generator. This same kind of chamber could be heated by burning coal or wood or by waste agricultural material. In the same way chamber 40 of FIG. 8 is heated in an alternate embodiment by waste industrial gases or unrefined oil field gases in order to provide a way of pumping water with otherwise unusable combustible materials. Thermoelectric generators then replace solar cells for electric power when the electric valve system is employed.

I claim:

1. A thermal energy, steam driven water pump comprising:

an alternating steam pressurization and vacuum production means comprising a cavity of multiple chambers of which one, first chamber is a steam generation chamber and is capable of being alternately first strongly heated and then cooled in a repeated sequence such that during the heated part of the sequence the heated chamber is capable of receiving by means of valving a small flow of water to be converted to steam by the heat of the chamber, and of which multiple chambers of the cavity there is a second chamber which is a water impeller chamber in fluid flow communication with said first chamber by interconnecting ducting capable of transmitting alternately pressurized steam from the first to the second chamber and then a vacuum from the second to the first chamber, with said second chamber having inlet and exit check valves and being capable of having water impelled from it by pressurized steam from said first chamber and also being capable of producing a vacuum by steam condensation during a second period and of receiving water during that second part of the sequence and, an internal water delivery means in the form of a water column capable of receiving periodic pressurization from the steam production and vacuum production means through ducting attached to valving capable of periodically admitting pressurized water from the water column to said steam generating chamber and, an internal water delivery control means capable of sequencing the opening and closing of the valving of the internal water delivery means that is used for steam generating, said internal water delivery control means being capble of opening valving for water flow to the steam generation chamber when high steam generation temperature is reached and of closing off valving and water flow when temperature declines in the steam generation chamber and, a heating means capable of strongly heating said steam pressurization means.

2. A steam driven water pump as in claim 1 in which the internal water delivery means providing the water for steam generation is a sealed, elevated chamber having delivery ducts at its base in which hydrostatic pressure is produced by the height of the water column in the chamber and is available to move water into the steam generation means during the high temperature part of the sequence, and said elevated chamber being capable of receiving water through ducting and valving from the water impelling chamber during the steam pressurization period and, also as in claim 13 in which additionally the internal water delivery control means is also capable of opening additional valving for water replenishment to the internal water delivery means during a part of the steam pressurization sequence and of closing this valving when replenishment is effected.

3. A steam driven water pump as in claim 1 in which the internal water delivery means providing the water for steam generation is a sealed, elevated chamber having delivery ducts at its base in which hydrostatic pressure is produced by the height of the water column in the chamber and is available to move water into the steam generation means during the high temperature part of the sequence, and said elevated chamber being capable of receiving water through ducting and valving by a check valve from a water source at ambient pressure during the vacuum production part of the sequence by means of ducting which transmits the vacuum over the water in the water delivery chamber at that time.

4. A steam driven water pump as in claim 1 in which the internal water delivery means, that delivers the water used for steam generation and is by means of a pressurized water column, is in the form of a chamber containing water and having compressed air above the water with said chamber being capable of receiving water through ducting and a check valve from the water impelling chamber during the steam pressurization period.

5. A steam driven water pump as in claim 1 in which the internal water delivery control means, controlling the flow of water that is used for conversion to steam, is a bank of valves operated by a valve control bar the position of which for opening and closing sets of valves during parts of the pumping sequence is determined by a sliding cam which is moved by a temperature sensitive bellows, the bellows being capable of moving the cam with the control bar to a hold position during all cool periods when steam is not to be generated, thereby closing all valves during this period, said bellows being also capable of moving the cam and the valve control bar to a high temperature position opening valves to admit water for steam production, and said bellows being capable of moving the cam and control bar to an intermediate position closing other valves but opening valves for water replenishment to the internal water delivery means.

6. A steam driven water pump as in claim 1 in which the internal water delivery control means that controls the water flow to the steam generation means is a bank of electric valves grouped in sets of two and an electrically operated, thermostatically controlled, valve switching mechanism capable of opening one set of valves to equalize steam pressure across an elevated column of water enabeling a gravity flow from the column into the steam generating means when temperature is adequately elevated for steam generation, and capable of later, during a cooled steam generating period, closing this first set and opening a second set which removes pressure from over said water column and allows pressure in the water impelling chamber to move water from that chamber to the column of water of the internal water delivery means, said valve switching mechanism being capable of subsequently closing all valves during a cooling and condensed period during which a vacuum is produced in the water impelling chamber and during which the steam generating chamber is heated.

7. A steam driven pump as in claim 1 in which the internal water delivery means is a chamber containing water and having compressed air above the water, said chamber being capable of receiving water through a check valve and through ducting from the water impelling chamber during the steam pressurization period, and said water delivery chamber being capable of exiting water to the steam generation means by a valve and, as in claim 1 having an internal water delivery control means in the form of an electrically powered and temperature sensing valve operating mechanism capable of opening a valve for water injection into the steam generating chamber from the internal water delivery means when a high steam generating temperature is reached, and said valve operating mechanism being capable of closing said valve after a drop in said steam generating temperature.

8. A steam driven water pump as in claim 1 in which the internal water delivery means is a chamber containing water and having compressed air above the water, said chamber being capable of receiving water through a check valve and through ducting from the water impelling chamber during the steam pressurization period, and said delivery chamber having a valve capable of enabling fluid flow communication to the steam generation means and, also as in claim 1 having an internal water delivery control means in the form of a valve operated by a valve control bar the position of which for opening and closing said valve during periods of the pumping sequence is determined by a sliding cam which is moved by a temperature sensitive bellows which is able to move the cam and the control bar to open the valve when a high steam generating temperature is reached and is able to close the valve when the temperature lowers.

9. A thermal energy, steam driven water pump as in claim 1 in which the heating means capable of strongly heating the steam pressurization means is a solar collector.

10. A steam driven water pump as in claim 1 in which the heating means able to strongly heat the steam pressurization means is a concentrating solar collector.

11. A steam driven water pump as in claim 1 in which the heating means capable of heating the steam generating chamber is a burner capable of combusting methane from a biogas generator.

12. A steam driven water pump as in claim 1 in which the heating means capable of strongly heating the steam generating chamber is a burner for combusting solid fuel material.

* * * * *